US006632107B1

(12) United States Patent
Vanbesien

(10) Patent No.: US 6,632,107 B1
(45) Date of Patent: Oct. 14, 2003

(54) ELECTRICAL CONNECTOR HAVING A CENTERING MEMBER

(75) Inventor: Johan Vanbesien, Ypres (BE)

(73) Assignee: Tyco Electronics Logistics AG, Steinach (CH)

( * ) Notice: Subject to any disclaimer, the term of this patent is extended or adjusted under 35 U.S.C. 154(b) by 81 days.

(21) Appl. No.: 09/663,213

(22) Filed: Sep. 15, 2000

(30) Foreign Application Priority Data

Sep. 17, 1999 (DE) ..... 199 44 705

(51) Int. Cl.[7] ..... H01R 13/64
(52) U.S. Cl. ..... 439/680; 439/65; 439/78
(58) Field of Search ..... 439/378, 680, 439/681, 65, 78, 676, 924.1, 181, 186

(56) References Cited

U.S. PATENT DOCUMENTS

| | | | | |
|---|---|---|---|---|
| 3,059,208 A | * | 10/1962 | Concelman | 439/381 |
| 4,820,169 A | * | 4/1989 | Weber et al. | 439/65 |
| 4,824,380 A | * | 4/1989 | Metthews | 439/78 |
| 5,125,849 A | * | 6/1992 | Briggs et al. | 439/378 |
| 5,591,039 A | * | 1/1997 | Matthews | 439/181 |
| 5,718,592 A | * | 2/1998 | Hosler et al. | 439/63 |
| 6,059,600 A | * | 5/2000 | Vanbesien | 439/378 |
| 6,126,475 A | * | 10/2000 | Matsuura et al. | 439/381 |

FOREIGN PATENT DOCUMENTS

| | | | |
|---|---|---|---|
| DE | 298 17 007 | 9/1998 | |
| WO | WO-97/28579 | * 8/1997 | H01R/9/09 |

OTHER PUBLICATIONS

The American Heritage Dictionary of the English Language, Third Edition copyright 1992 by Houghton Mifflin Company. Electronic version licensed from INSO Corporation.*

* cited by examiner

*Primary Examiner*—Tho D. Ta
*Assistant Examiner*—James R. Harvey
(74) *Attorney, Agent, or Firm*—Barley Snyder

(57) ABSTRACT

The invention relates to a connector and connector system between a first substrate (1) which may be, for example, a back plane with a male connector (2), and a second substrate (3) on which a corresponding female connector (4) is mounted. For centering and coding, the first substrate has a perpendicularly projecting guide pin (6) arranged thereon on which a coding key (7) is mounted which, during connection of first substrate (1) and second substrate (3), is introduced during the mating operation into a coding box (8) having a corresponding complementary coding key (11). The guide pin (6) is clampingly retained in coding box (8) via a spring contact (10).

With short centering pins, centering of the guide pin (6) in coding box (8) takes place by the cooperation of coding key (7) and complementary coding key (11). For avoiding damage to the spring contact (10) in coding box (8) in case of longer guide pins, the invention provides for the insertion of an additional centering member (12) in the coding box (8) between the complementary coding key (11) and the spring contact (10).

18 Claims, 4 Drawing Sheets

Prior Art

ELECTRICAL CONNECTOR HAVING A CENTERING MEMBER

FIELD OF THE INVENTION

The invention relates to an electrical connector system and more particularly to a system for connecting first and second substrates.

BACKGROUND

An example of such a connector system is disclosed in German Utility Model D-EUM 298 17 007 and Standard IEC 1076-4-102, respectively. The first substrate in this connector system is usually a backplane or mother board on which a male connector is mounted. The male connector typically contains plurality of contacts. The second substrate is usually a component assembly on which a complementary female connector is mounted. The female connector usually contains a plurality of contacts.

Guide pins are provided on one of the substrates for pre-centering the first substrate with respect to the second substrate, so that the female and male connectors fit together precisely without stubbing their contacts. Moreover, a coding key on the guide pin as well as the complementary coding key in a coding box serve to associate the male connector with the proper complementary female connector.

In the design according to Standard IEC 1076-4-102, the length of the guide pins is limited to a maximum of 32 mm. The coding box is designed such that the guide pin, upon insertion, is centered by the cooperation of the coding key with the guide pin and the complementary coding key. During insertion, the guide pin and coding key first engage the complementary coding key to center the guide pin before the tip of the guide pin touches a spring contact inside the coding box. Thus, coarse pre-centering is effected by insertion of the guide pin in the complementary coding key on the coding box and fine centering is effected by the cooperation of coding key and complementary coding key.

Due to the fact that this connector system is employed for a huge variety of types of female and male connectors, a problem arises with larger heights of female and male connectors in that the length of the guide pin according to IEC 1976-4-102 is too short for pre-centering in some connector systems. Lengthening of the guide pin in turn causes a problem in that during insertion, the tip of the guide pin touches the spring contact in the coding box before it becomes centered by way of the cooperation of coding key and complementary coding key. In case of oblique insertion of the guide pin without appropriate centering, there is thus the risk that the spring contact in the coding box is bent or completely damaged. Such damage may render the connector system inoperable.

SUMMARY

It is thus the object of the invention to develop a connector system of the type indicated here in such a manner that also guide pins of greater length than according to IEC 1076-4-102 can be used without the risk of bending of the spring contact in the coding box upon insertion of the guide pin.

According to the invention, this and other objects are achieved by providing an additional centering member for the guide pin which is formed on the coding box between the complementary coding key and the spring contact. The guide pin during insertion is therefore centered before touching the spring contact and thus cannot damage or bend the spring contact.

BRIEF DESCRIPTION OF THE DRAWINGS

The invention will be described in greater detail with reference to the accompanying figures of which.

DETAILED DESCRIPTION OF THE PREFERRED EMBODIMENT

Figure 1:
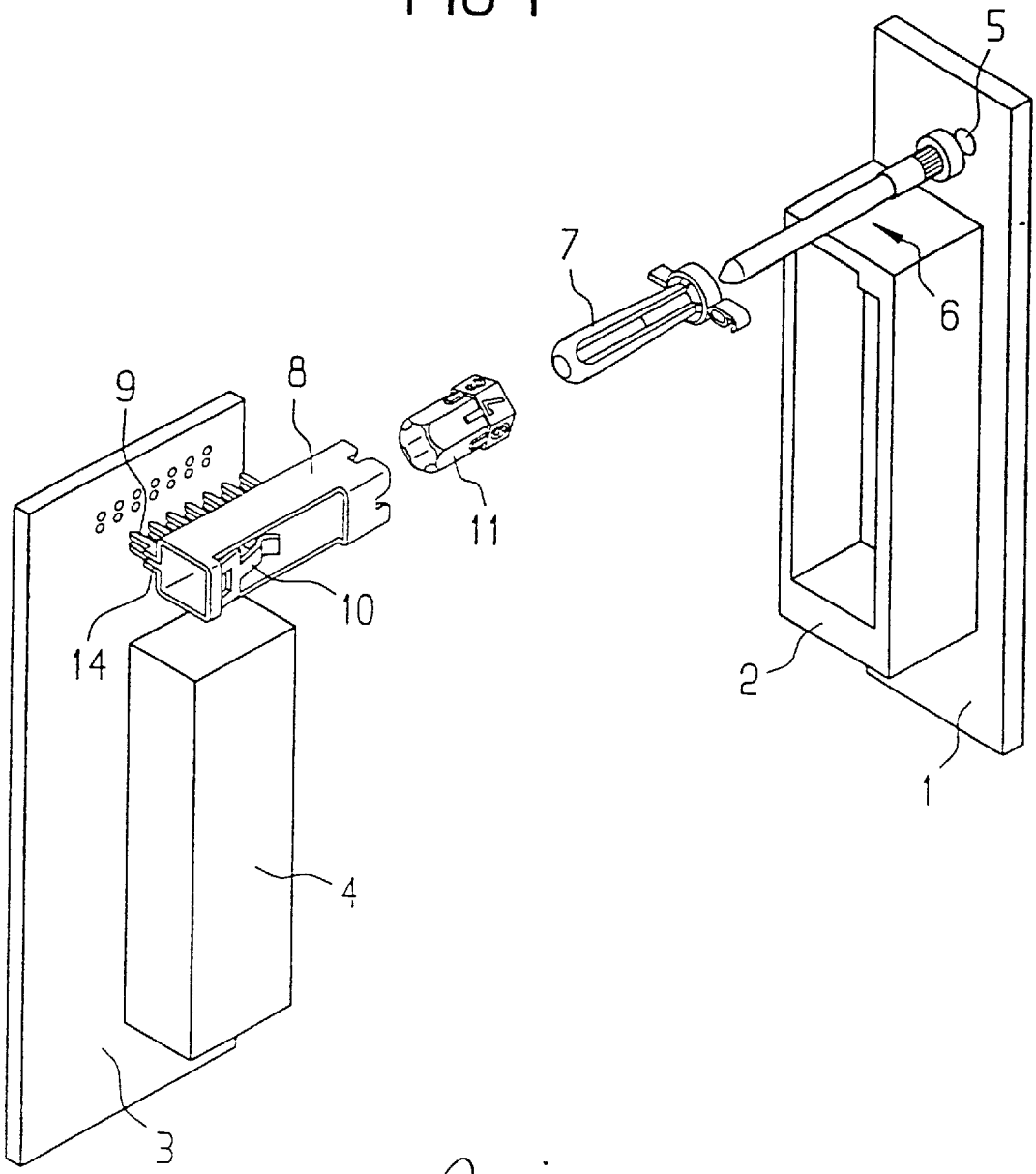
FIG. 1 shows a perspective view of a connector system according to the prior art.

FIG. 1 shows a perspective view of a connector system according to the prior art, as illustrated in DE-UM 298 17 007 and IEC 1076-4-102, respectively. This connector system consists of a first substrate 1 having a male connector 2 arranged thereon. This first substrate 1 with the male connector 2 is to be mated with a second substrate 3 having a female connector 4. Substrate 3 with female connector 4 may be, for example, a component assembly, and substrate 1 with male connector 2 may be a back plane or mother board. To obtain centering during mating of male and female connectors as well as coding for selection of the proper male connector with respect to the proper female connector, the first substrate has a perpendicularly projecting guide pin 6 attached thereto via a connecting hole 5. A sleeve shaped coding key 7 is slid on guide pin 6 for coding. The substrate 3 with the female connector 4 has a coding box 8 provided thereon for receipt of guide pin 6, with the coding box 8 being attachable to substrate 3 via press fit terminals 9. Coding box 8 is open on both ends in mating direction and has a spring contact 10 that is biased toward and in engagement with the guide pin 6 when the connector are mated.

A complementary coding key 11 is adapted to be attached to the mating end of coding box 8. During mating of this connector system, the guide pin 6 is centered by way of the cooperation of coding key 7 and complementary coding key 11 before the tip of the guide pin 6 touches the spring contact 10.

Referring now to FIGS. 2–5, in applications where the guide pin length must be increased beyond the prescribed length of Standard IEC 1076-4-102, the connector system according to the invention provides an additional centering member 12 which is inserted between complementary coding key 11 and coding box 8. The connector system according to the invention utilizes many of the components of the connector system of FIG. 1, with the exception of the additional centering member 12 and the greater length of guide pin 6. The component parts corresponding to the connector system of FIG. 1 are designated with the same reference numerals in the following FIGS. 2 to 5 and will not be described in more detail.

Figure 2:
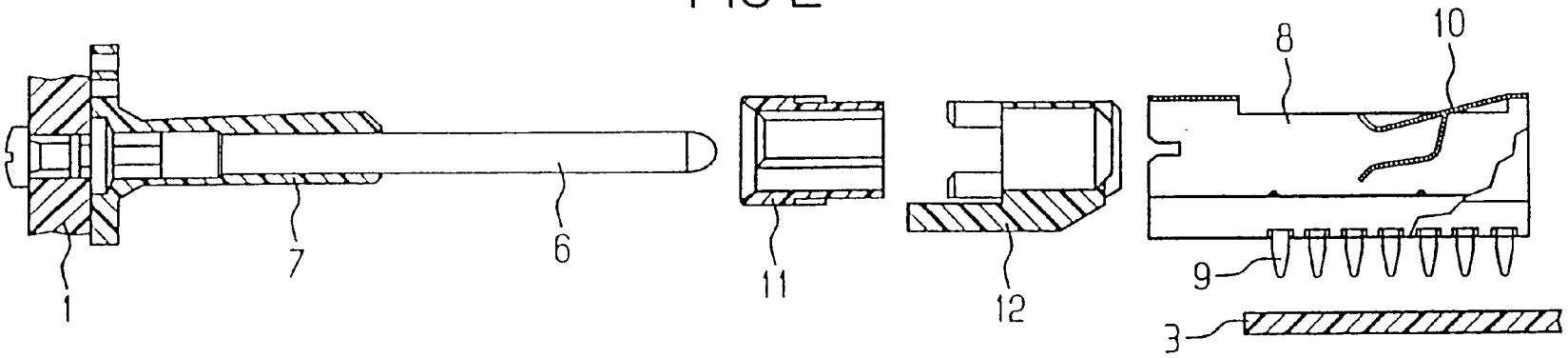
FIG. 2 shows an exploded side view of the connector system according to the invention.

FIG. 2 shows an exploded side view of the connector system according to the invention. Centering member 12 is arranged between complementary coding key 11 and coding box 8.

Figure 3:
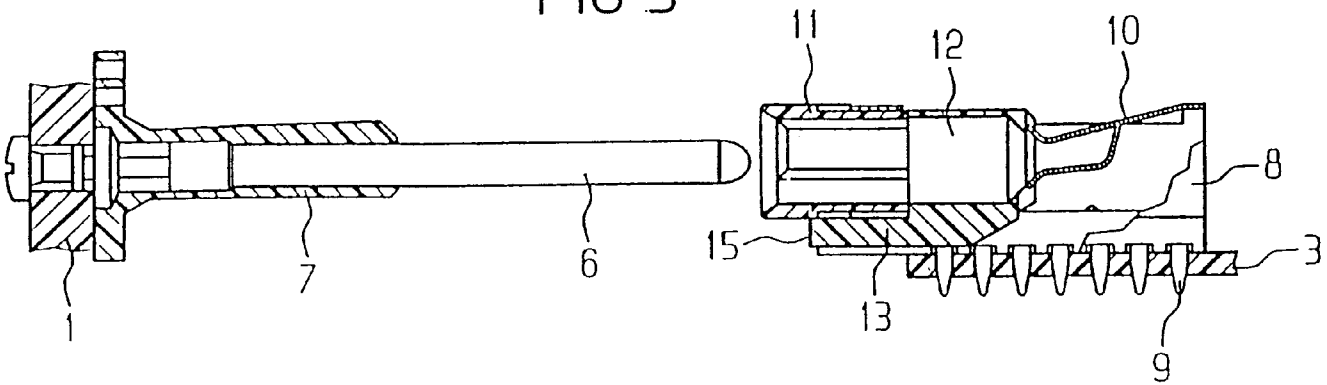
FIG. 3 shows the connector system of FIG. 2 together with the centering member inserted in the coding box and with the complementary coding key.

FIG. 3 depicts the centering member 12 inserted in coding box 8. Centering member 12 is inserted into coding box 8 to a position adjacent to a mating end of the spring contact 10. Complementary coding key 11 also is inserted in coding box 8, with the insertion of complementary coding key 11 being not changed or hindered by the inserted centering member 12.

As shown in FIG. 3, the guide pin 6 has a fastening section 22 at a first end and a pre-engagement guide section 21 at a second end. The fastening section 22 has a fastening zone 24 and a guide zone 23. The fastening zone 24 is configured as a sturdy press-fit zone for press-fitting of the guide pin 6 in a mounting hole 20 in the first substrate 1.

Figure 4:
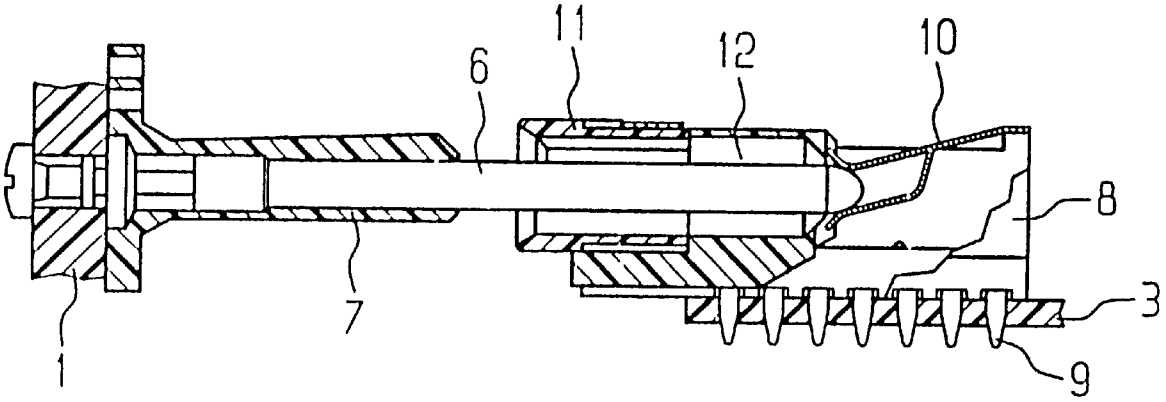
FIG. 4 shows a view as in FIG. 3, with the guide pin halfway inserted in the coding box.

Mating of the connector system will now be described in greater detail. In FIG. 4, guide pin 6 is already introduced into coding box 8 to such an extent that the tip of guide pin 6 already contacts the spring contact legs of spring contact 10. As is clearly visible in this view, coding key 7 arranged on guide pin 6 still is spaced apart from complementary coding key 11, so that centering of the guide pin 6 via the cooperation of coding key 7 and complementary coding key 11 does not yet take place. The tapered inner contour of the centering member 12 serves to guide the guide pin pin 6 into proper position prior to engaging the spring contact 10. If centering member 12 were not provided, the tip of the guide pin 6 would not be centered and could stub or bend the contact legs of spring contact 10 in downward or upward direction.

Figure 5:
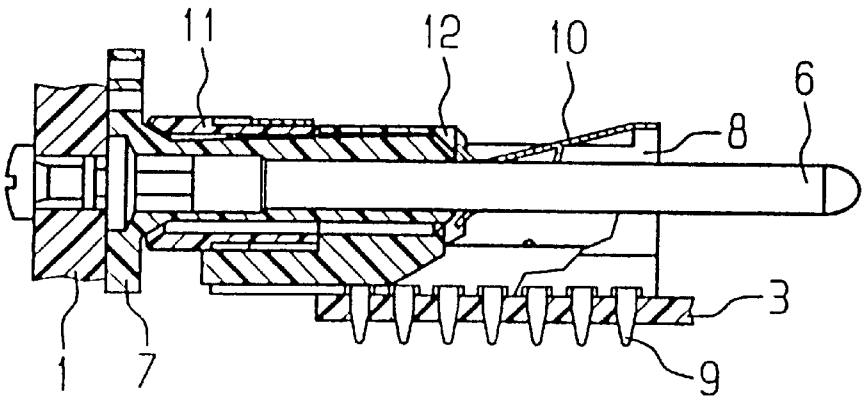
FIG. 5 shows a view as in FIG. 3 or 4 with fully inserted guide pin.

The illustration of FIG. 5 shows guide pin 6 completely inserted in coding box 8. The tip of guide pin 6 projects from a rear end of coding box 8. Coding key 7 is inserted into complementary coding key 11, with the internal dimensions of centering member 12 being selected such that the front portion of coding key 7 can be received therein in all possible modifications.

Figure 8:
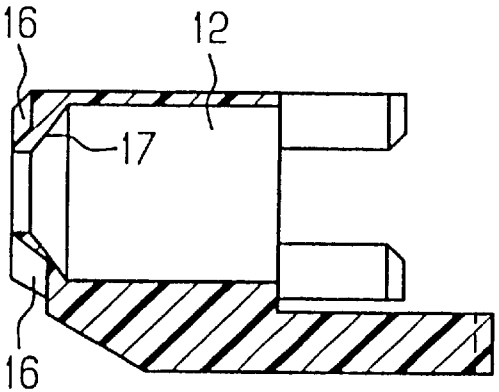
FIG. 8 shows a sectional view along the line VIII—VIII of FIG. 7.
Figure 7:
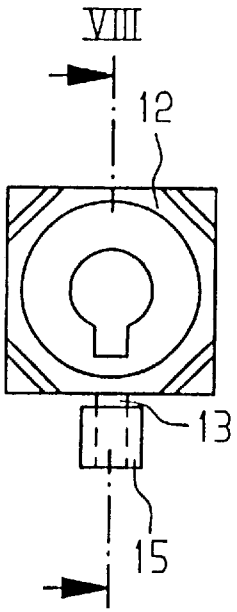
FIG. 7 shows a view of the centering member as seen in mating direction.
Figure 6:
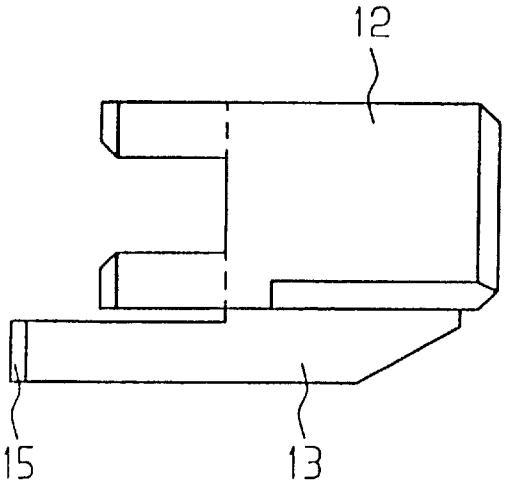
FIG. 6 shows a side view of the centering member.

FIGS. 6 to 8 better illustrate the detailed geometry of centering member 12, FIG. 6 showing a side view, FIG. 7 showing the centering member in mating direction and FIG. 8 showing a lateral sectional view along the line VIII—VIII of the centering member of FIG. 7.

The external geometry of the centering member is selected such that it can be fit into coding box 8. On the bottom side, centering member 12 has a web 13 which, during insertion into coding box 8, is introduced into a corresponding groove 14 (FIG. 1). Web 13, at its mating end, has a stop 15 preventing the centering member 12 from being inserted too far into coding box 8. At the end of the web 13, as seen in mating direction, there is formed a stop 15, which prevents that the centering member 12 from being pushed too far against the spring contact 10.

On the rear end, centering member 12 is provided with recesses 16 for receiving the tips of the spring contact legs of spring contact 10. The internal contour of centering member 12 is formed with a conical centering area 17 facing the mating end, through which guide pin 6 is guided exactly between the spring contact legs of spring contact 10.

As for the rest, the internal geometry is selected such that the coding key 7 can be accommodated therein in all possible various modifications. It should be understood by those reasonably skilled in the art that while the invention has been described illustratively with reference to a particular connector system shown in these drawings, it may be utilized in other connectors having similar centering problems. For example, variations to the cantering member geometry may be made to fit into various connector housings. Also, various key configurations are possible for mating with complementary keys of complementary connectors. The invention is intended to be limited only by the scope of the following claims.

Advantageously, in case of guide pins having a length of more than 32 mm, the centering member 12 can be inserted into the coding box, while in case of use of guide pins with a length of less than 32 mm, the centering member can be dispensed with.

The centering member 12 is designed such that it can be inserted into the coding box 8 and the complementary coding key 11 can be applied onto the coding box 8 also when the centering member 12 is inserted. The applied complementary coding key 11 at the same time serves to fix the centering member 12 in its position.

To prevent the centering member 12 from contacting the spring contact 10 during insertion, the coding box 8 advantageously is formed with an obliquely extending groove 14 and the centering member 12 is formed with a corresponding web 13 that is received in the groove 14 upon inserting of the centering member 12 into the coding box 8. At the end of the web 13, as seen in mating direction, there is formed a stop 15, which prevents the centering member 12 from being pushed too far against the spring contact 10.

What is claimed is:

1. An electrical connector for receiving a guide pin of a mating connector comprising:

a coding box having a contact disposed at a rear end;

a coding key disposed in the coding box at a mating end; and, a centering member disposed inside the coding box between the contact and the coding key, the centering member being adapted to be inserted in the coding box from the mating end and positioned to receive the guide pin and pre-align the guide pin before the guide pin engages the contact to prevent stubbing with the contact wherein the coding box has a groove and the centering member has a complementary web, the web, during insertion of the centering member into coding box, being received in the groove, the web having a stop which prevents the centering member from being over-inserted into the coding box.

2. The electrical connector of claim 1 wherein the guide pin is longer than 32 millimeters.

3. The electrical connector of claim 1 wherein the coding box has a groove and the centering member has a complementary web, the web, during insertion of the centering member into coding box, being received in the groove, the web having a stop which prevents the centering member from being overinserted into the coding box.

4. The electrical connector of claim 1 wherein the centering member has a conical internal contour to pre-align the guide pin between legs of the contact.

5. The electrical connector of claim 1 wherein the coding key is adapted to be attached to the coding box also when the centering member is inserted, and locks the centering member is its position.

6. A connector system having a first substrate in which at least one perpendicularly projecting guide pin is attached on which a coding key is mounted, and having a second substrate having a coding box arranged thereon for receiving the guide pin during the mating operation, the coding box having a complementary coding key inserted therein from a mating end and an electrical spring contact being formed on the coding box rearward of the complementary coding key, said electrical spring contact clampingly retaining the inserted guide pin in the coding box, the connector system comprising a centering member for pre-aligning the guide pin during insertion, the centering member being positioned inside the coding box between the complementary coding key and the spring contact so that the guide pin is received in the centering member before the coding key cooperates with the complementary coding key.

7. The connector system of claim 6 wherein the guide pin is longer than 32 millimeters.

8. The connector system of claim 6 wherein the centering member is formed separately from the coding box.

9. The connector system of any of claim 6 wherein the centering member is adapted to be inserted in the coding box from the mating end.

10. The connector system of claim 9 wherein the complementary coding key is adapted to be attached to the coding box and to lock the centering member in its position.

11. The connector system of claim 9 wherein the coding box has a groove and the centering member has a complementary web, the web, during insertion of the centering member into coding box, being received in the groove, the web having a stop which prevents the centering member from being overinserted into the coding box.

12. An electrical connector system for forming an electrical connection between a pair of substrates comprising:

a guide pin fastened to the first substrate, the guide pin having a pre-engagement guide section and a fastening section, the fastening section having a fastening zone and a guide zone, said fastening zone having a predetermined diameter and configured as a sturdy press fit zone to be mounted in a mounting hole of the first substrate;

a female connector fixed to the second substrate having a coding box, the coding box having a contact disposed at a rear end thereof, a coding key disposed within the coding box at a mating end thereof, and a centering member disposed inside the coding box between the contact and the coding key, the centering member positioned to receive the guide pin and pre-align the guide pin before the guide pin engages the contact to prevent stubbing of the contact.

13. The electrical connector system of claim 12 wherein the centering member is formed separately from the coding box.

14. The electrical connector system of claim 12 wherein the centering member is adapted to be inserted in the coding box from the mating end.

15. The electrical connector system of claim 14 wherein the coding key is adapted to be attached to the coding box also when the centering member is inserted, and locks the centering member in its position.

16. The electrical connector system of claim 14 wherein the coding box has a groove and the centering member has a complementary web, the web, during insertion of the centering member into coding box, being received in the groove, the web having a stop which prevents the centering member from being overinserted into the coding box.

17. The connector system of claim 6 wherein the centering member has a conical internal contour to pre-align the guide pin between legs of the spring contact.

18. The electrical connector system of claim 12 wherein the centering member has a conical centering area to pre-align the guide pin between legs of the contact.

* * * * *